US011492818B1

(12) United States Patent
McVay

(10) Patent No.: US 11,492,818 B1
(45) Date of Patent: Nov. 8, 2022

(54) POST REPAIR AND REINFORCEMENT APPARATUS

(71) Applicant: Julian McVay, Carrollton, TX (US)

(72) Inventor: Julian McVay, Carrollton, TX (US)

( * ) Notice: Subject to any disclaimer, the term of this patent is extended or adjusted under 35 U.S.C. 154(b) by 0 days.

(21) Appl. No.: 17/222,204

(22) Filed: Apr. 5, 2021

Related U.S. Application Data

(63) Continuation-in-part of application No. 17/248,409, filed on Jan. 23, 2021, now abandoned.

(51) Int. Cl.
*E04H 12/22* (2006.01)
*E04G 23/02* (2006.01)
*E04H 17/20* (2006.01)

(52) U.S. Cl.
CPC ..... *E04H 12/2292* (2013.01); *E04G 23/0218* (2013.01); *E04H 17/21* (2021.01)

(58) Field of Classification Search
CPC .. E04H 12/2292; E04H 17/21; E04G 23/0218
USPC ..... 52/514, 514.5, 742.13, 742.14, 170
See application file for complete search history.

(56) References Cited

U.S. PATENT DOCUMENTS 1,044,921 A * 11/1912 Schneider ..... E04H 17/10 256/52
1,790,136 A * 1/1931 Dalrymple ..... A47G 29/1216 248/145
2,378,814 A * 6/1945 Wascher ..... E04H 17/06 52/573.1
5,009,394 A 4/1991 Marshall
5,224,687 A 7/1993 Geckler et al.
5,372,162 A * 12/1994 Frey ..... F16L 55/1645 264/270
5,636,482 A 6/1997 Klager
5,833,215 A 11/1998 Vandenburg
5,909,910 A 6/1999 Shaffer
6,202,371 B1 * 3/2001 Natelli, Jr. ..... E04H 12/2292 52/832
6,282,861 B1 * 9/2001 Natelli, Jr. ..... E04H 12/2292 52/852
6,287,042 B1 * 9/2001 Eriksson ..... E04H 12/32 403/267
6,289,636 B1 * 9/2001 White ..... E01F 9/685 248/548

(Continued)

FOREIGN PATENT DOCUMENTS

GB 2210135 A * 6/1989 ..... E02D 5/226
KR 20100120727 A * 11/2010 ..... E04H 12/2292

(Continued)

*Primary Examiner* — Brent W Herring
(74) *Attorney, Agent, or Firm* — Law Office of Sam Sokhansanj PLLC

(57) ABSTRACT

A method of repairing and reinforcing a tubular fence post that is easy and safe to use, simple in design and inexpensive to manufacture, and is further portable, and highly efficient in repairing and reinforcing damaged posts, among other advantages. The method can include inserting a first stake having a plurality of vanes from a top open end of a tubular post, wherein the tubular post is damaged or compromised at a first location along its length. The method can further include positioning the first stake within the tubular post, such that the stake is positioned adjacent to the first location, thereby reinforcing the tubular post.

20 Claims, 5 Drawing Sheets

(56) References Cited

U.S. PATENT DOCUMENTS 6,742,314 B2 * 6/2004 Young ..... E04C 3/30 52/835
7,003,919 B2 * 2/2006 Riker ..... H01B 1/24 52/298
7,329,444 B2 * 2/2008 Boaz ..... B29C 70/32 156/169
7,426,807 B2 * 9/2008 Cadwell ..... E04C 3/34 52/834
10,451,233 B1 * 10/2019 Izradel ..... H02S 40/38
2001/0045553 A1 * 11/2001 Pilcher ..... E04H 12/2292 256/64
2003/0145554 A1 * 8/2003 Young ..... E04H 12/2292 52/848
2004/0228995 A1 * 11/2004 Boaz ..... B29C 70/32 428/36.1
2005/0223673 A1 * 10/2005 Cadwell ..... E04H 12/02 52/834
2005/0279417 A1 * 12/2005 Bednarzik ..... F16L 55/179 138/93
2006/0266910 A1 * 11/2006 Plante ..... E02D 5/801 248/499
2007/0049429 A1 * 3/2007 White ..... A63B 71/023 473/479
2010/0024356 A1 * 2/2010 Knight ..... E04H 12/2292 52/745.18
2015/0184785 A1 * 7/2015 Richards, Jr. ..... F16L 58/1027 138/97
2015/0362116 A1 * 12/2015 Thompson ..... F16L 55/1658 138/97

FOREIGN PATENT DOCUMENTS

WO WO-0071830 A1 * 11/2000 ..... E01F 9/675
WO WO-2005068750 A1 * 7/2005 ..... E04H 12/2292
WO WO-2011103643 A1 * 9/2011 ..... A01G 17/14

* cited by examiner

DETAIL B

SECT A-A

POST REPAIR AND REINFORCEMENT APPARATUS

CROSS REFERENCE TO RELATED APPLICATIONS

This application is a continuation-in-part (CIP) of U.S. Non-Provisional application Ser. No. 17/248,409 filed on Jan. 23, 2021, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Posts are in worldwide use today primarily as support for fences, particular of the metal kind. Further, the metal post is typically a hollow tube or pipe which can have a round, circular, square or even rectangular cross-section. Although posts have other uses, it is most frequently their use in fences that may be susceptible to damage and repair, such as being bent, separated, rusted, or otherwise damaged and have impaired structural integrity. Accordingly, wherever fence posts are used, it is at times necessary to remove them from the ground due to damage. In particular, a broken or bent hollow post requires significant labor and time for its removal and replacement, and rarely are post repaired. The conventional post pullers and extractors are inconvenient to use, expensive to manufacture, and in some instances even dangerous to the individual using them. Further, most conventional post removal devices have been designed with numerous parts, both moving and otherwise, making them cumbersome, complex, and further prone to malfunction and damage. In addition, the removal and disposal of posts that may be otherwise repairable creates additional environmental waste.

Hence, what is needed is a post repair and reinforcement apparatus that is easy to use, safe to use, simple in design and inexpensive to manufacture, portable, and highly efficient in repairing and reinforcing damaged posts.

BRIEF SUMMARY

In one aspect of the disclosure described herein, a method of repairing and reinforcing a tubular post is disclosed that is easy and safe to use, simple in design and inexpensive to manufacture, portable, and highly efficient in repair and reinforcing damaged posts. The method can include inserting a first stake having a plurality of vanes from a top open end of a tubular post, wherein the tubular post is damaged or compromised at a first location along its length. The method can further include positioning the first stake within the tubular post, such that the stake is positioned adjacent to the first location, thereby reinforcing the tubular post. In addition, the first stake can include a tapered end. Further, the step of positioning can also include aligning a middle region of the first stake adjacent to the first location. The method may also include disposing, applying, or pouring a substance within the tubular post to harden or cure for a time period within the post. In addition, the substance can be concrete, adhesive, or a sealant. The method may also include inserting a second stake having a plurality of vanes from a top open end of the tubular post, wherein the tubular post is damaged or compromised at a second location along its length. The method can further include positioning the second stake within the tubular post, such that the second stake is positioned adjacent to the second location, thereby further reinforcing the tubular post.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
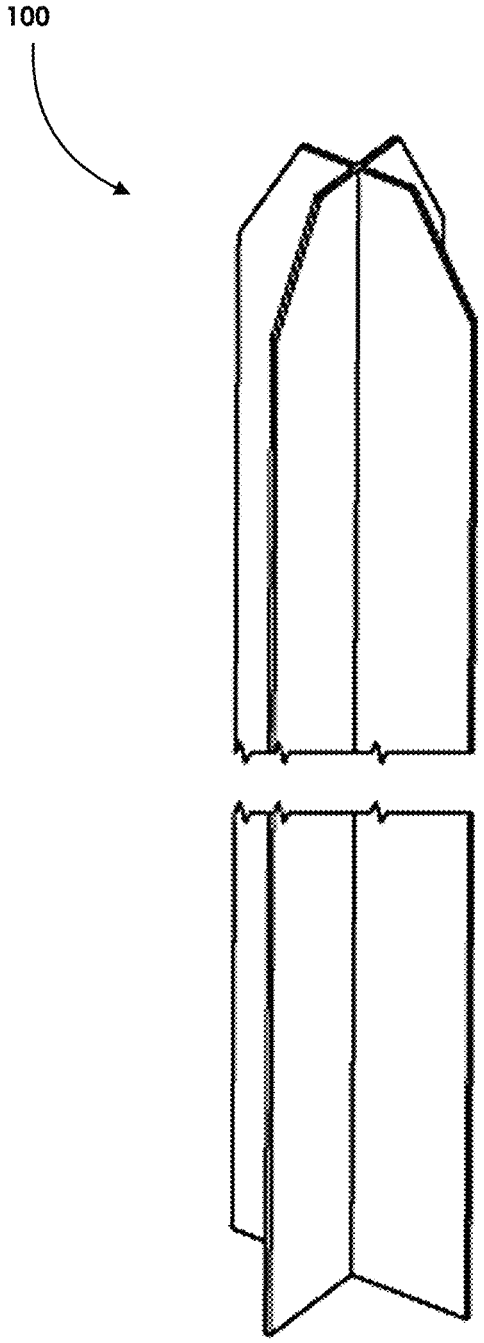
FIG. 1 illustrates a partial perspective cut-away view for one non-limiting exemplary embodiment of a post repair and reinforcement apparatus of the disclosure described herein.
Figure 2A:
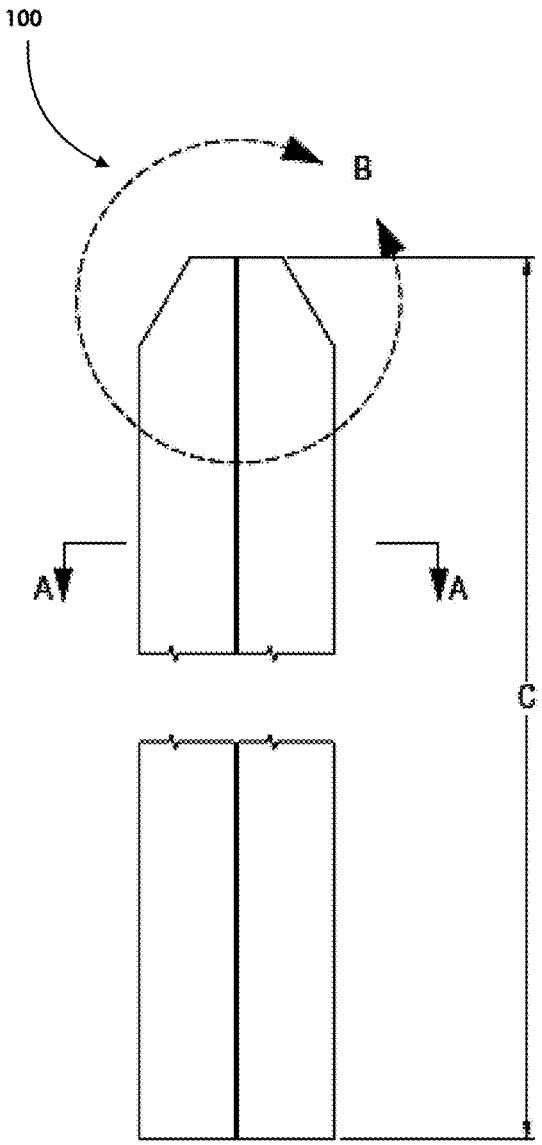
FIG. 2A illustrates a partial cut-away side view the post repair and reinforcement apparatus of FIG. 1.
Figure 2B:
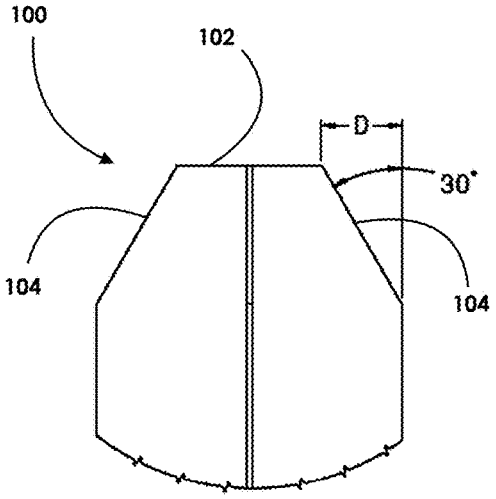
FIG. 2B illustrates a close-up side view of an upper or distal region of the post repair and reinforcement apparatus of FIG. 1.
Figure 2C:
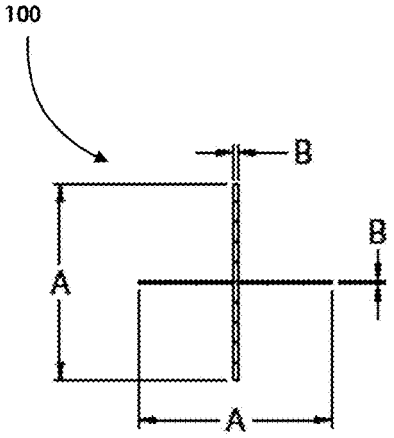
FIG. 2C illustrates partial cross-sectional view for one fin or vane of the post repair and reinforcement apparatus of FIG. 1.

FIGS. 1-2C illustrates one non-limiting embodiment of a fence post repair and reinforcement apparatus 100 of the disclosure described herein, which may also be referred to herein as stake 100. Here, stake 100 may include a plurality of fins or vanes 102 configured in a crossed or x-shaped configuration. In one embodiment, stake 100 may include four (4) vanes 102 equally distanced apart. However, it is contemplated within the scope of the present disclosure described herein that stake 100 may include any number vanes, such as from three (3) up to one hundred. In addition, each vane may have any appropriate thickness depending on the application. For example, depending on the application, vanes 102 may be thin and of a material that allows for a certain amount of flexibility or bending. Alternatively, vanes 102 may be of a rigid material that prevents any of vanes 102 from bending or flexing. Here, it is preferable that stake 100 and its vanes 102 be made of galvanized steel. However, it is contemplated within the scope of the present disclosure described herein stake 100 and any its vanes 102 may be made of any material, including but not limited to any type or combination of alloys, metals, plastics, or wood, among others. In addition, stake 100 can be about 48-in in length, however, it is contemplated within the scope of the disclosure described herein that stake 100 may have any length, such as from about 2-in up to and including about 288-in.

Still referring to FIGS. 1-2C, near the distal region of stake 100, each vane 102 may include a cut-away or sloped region or face 104, thereby forming a tapered distal end region. In one embodiment, sloped region 104 is configured to be at about an angle of 30° relative to a vertical axis or vertical plane. However, it is contemplated within the scope of the present disclosure described herein that sloped region 104 may be at any acute angle relative to a vertical axis or vertical plane, such as from 5° up to 85°. In particular, the small diameter or width of the distal region of stake 100 and the angle of sloped region 104 allows stake 100 to be inserted and driven into a post that has its interior walls deformed, constricted, bent, or otherwise damaged. In addition, the sloped region 104 of the vanes 102 further allow stake 100 more easily be driven into the ground or earth.

Figure 3:
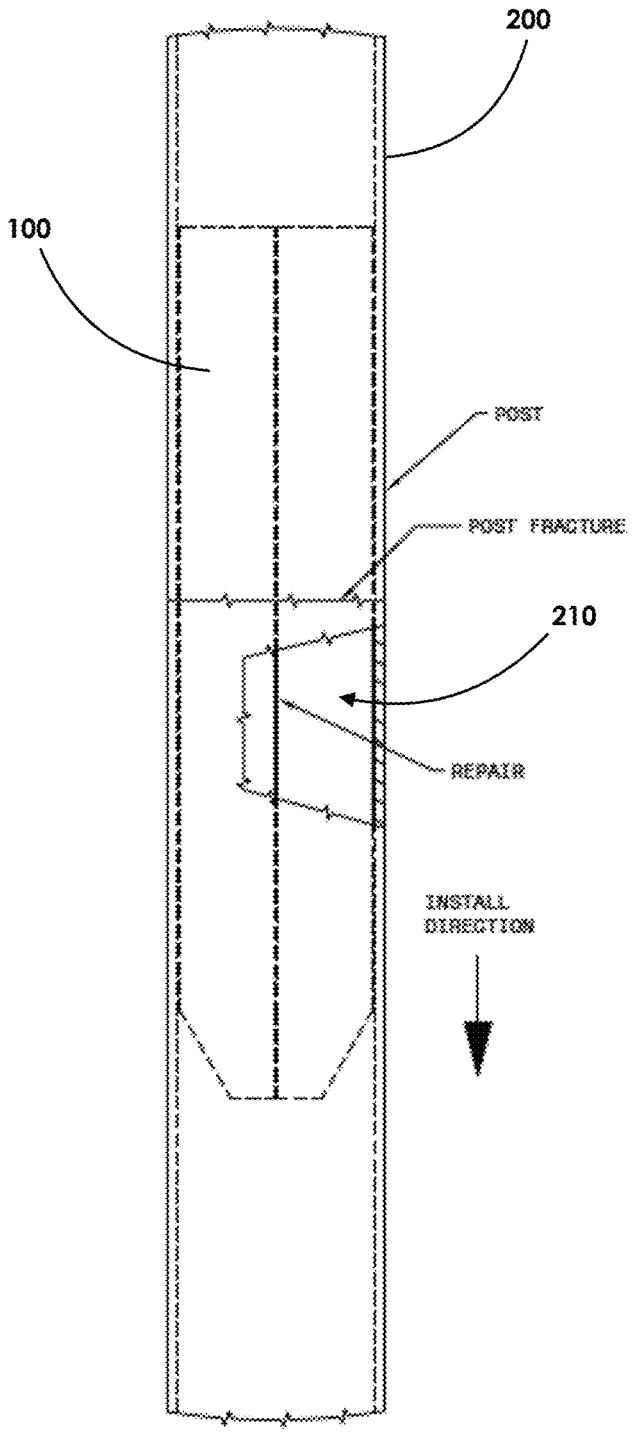
FIG. 3 illustrates a partial cross-sectional side view of a post and the post repair and reinforcement apparatus of FIG. 1, further illustrating one non-limiting exemplary embodiment of a method of repairing the post via the apparatus of the disclosure described herein.

Referring to FIG. 3, stake 100 is shown in one method of repairing and reinforcing a damaged tubular post 200. Here, stake 100 can be used to repair and reinforce any type of tubular or hollow post, including but not limited to posts, pipes, or tubes having a cylindrical, round, rectangular, square, or triangular cross-section. Here, stake 100 is shown inserted within damaged post 200. Specifically, post 200 is shown having a post fracture along its diameter or width, in addition to a compromised, cracked, damaged, or open area 210 requiring repair. In particular, the post fracture area and the open area 210 compromise the structural rigidity of post 200. Here, stake 100 can be inserted and driven inside of post 200 such that the middle region of stake 100 is positioned or disposed in or near the fracture area and the open area 210 from within post 200. Here, the width or diameter of stake 100 is configured such that is substantially the same or near the same (with a small tolerance) with respect to the inner wall diameter or width of post 200, such that the outer faces of vanes 102 of stake 100 form a tight friction or press-fit within the interior wall space of post 200. In addition, the tapered region of stake 100 in combination its vanes further allow the stake to self-center within post 200. Further, any type of lubing, grease, or oil may be applied to stake 100 to assist it in being inserted and driven down post 200.

Still referring to FIG. 3, stake 100 may be initially inserted and driven into post 200 via any type of hammer or mallet (or any apparatus that may function as a weighted hammer) and further driven deeper down with post 200 in combination with a driving force of an elongated rod, pipe, or tube in combination with the hammer or mallet. Here, once stake 100 has reached a defined depth within post 200, it is configured to stay in place, thereby repairing, supporting, and reinforcing post 200. In addition, any type of material, substance, or fluid may be further poured down or disposed within post 200 and over stake 100 (the material, substance, or fluid flowing passthrough or along vanes 102) to further harden and reinforce post 200 and stake 100. For example, such material may include concrete or any type of adhesive or polymer that may be cured to harden. In addition, any type of sealant or paint may be used on the outer surface of post 200 to further prevent environmental damage to post 200 or stake 100, such as preventing corrosion.

Still referring to FIG. 3, if the post is previously fractured into two separate pieces, then stake 100 may first be driven into the lower or upper piece to about a halfway point. Next, the opposing lower or upper piece can be slid or driven over stake 100, such that the upper and lower ends of the upper and lower pieces meet at a junction, and can be further sealed at the junction region.

Figure 4A:
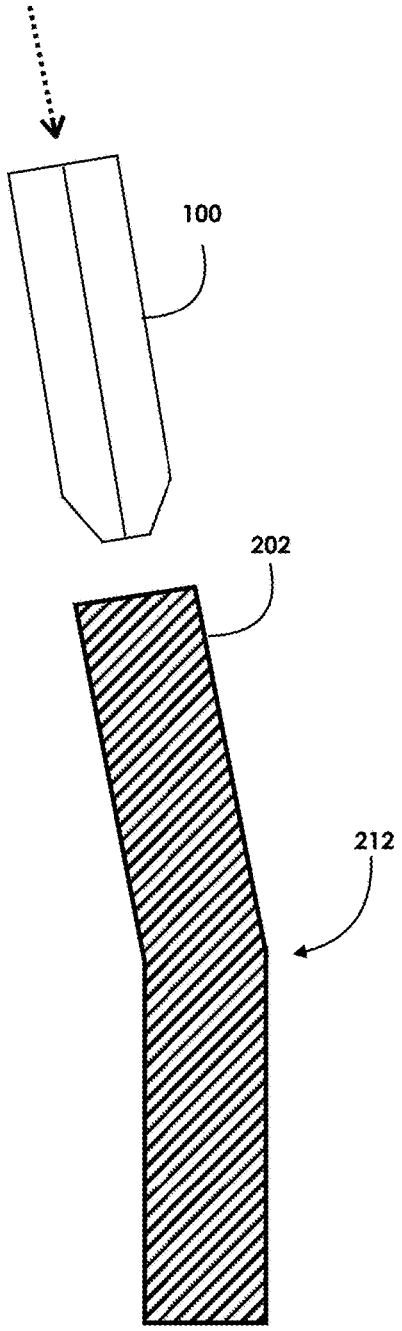
FIGS. 4A-4C illustrates a partial cross-section side view of a post and the post repair and reinforcement apparatus of FIG. 1, further illustrating another non-limiting exemplary embodiment of a method of repairing the post via the apparatus of the disclosure described herein.
Figure 4B:
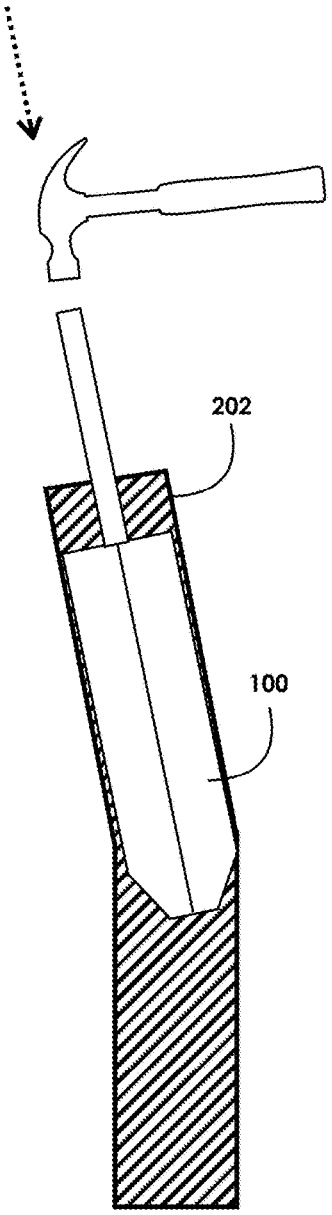
Figure 4C:
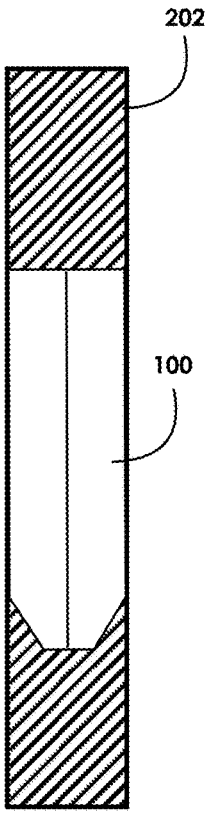

FIGS. 4A-4C illustrate another non-limiting exemplary embodiment of stake 100 being inserted within damaged post 202 to repair and reinforce it. In particular, a cross-sectional side view of hollow tubular post 202 is shown having a bent configuration at the structurally compromised middle region 212. Here, as stake 100 is being inserted, piled, and driven downward inside of post 202 via any hammer or mallet apparatus in combination with a separate pipe or rod, the structurally rigid of vanes 102 of stake 100 assert force and pressure within the interior walls of post 202, such that the straight configuration of stake 100 further work to straighten the top region of post 202 relative to its straight and upright lower region of post 202. Here, stake 100 can be further situated or fixed within the middle area of post 202 whereby the post fracture or bend previously occurred, namely, region 212, thereby reinforcing the structural rigidity of region 212 of post 202. In addition, the tapered region of stake 100 in combination its vanes further allow the stake to self-center within post 202. Further, any type of lubing, grease, or oil may be applied to stake 100 to assist it in being inserted and driven down post 202. In addition, any type of material, fluid, or substance may be further poured or disposed within post 202 and over stake 100 (the fluid, substance, or material flowing passthrough or along vanes 102) to further harden and reinforce post 202 and stake 100. For example, such substance or material may include concrete or any type of adhesive or polymer that may be cured to harden. In addition, any type of sealant or paint may be used on the outer surface of post 202 to further prevent environmental damage to post 202 or stake 100, such as preventing corrosion.

Figure 5A:
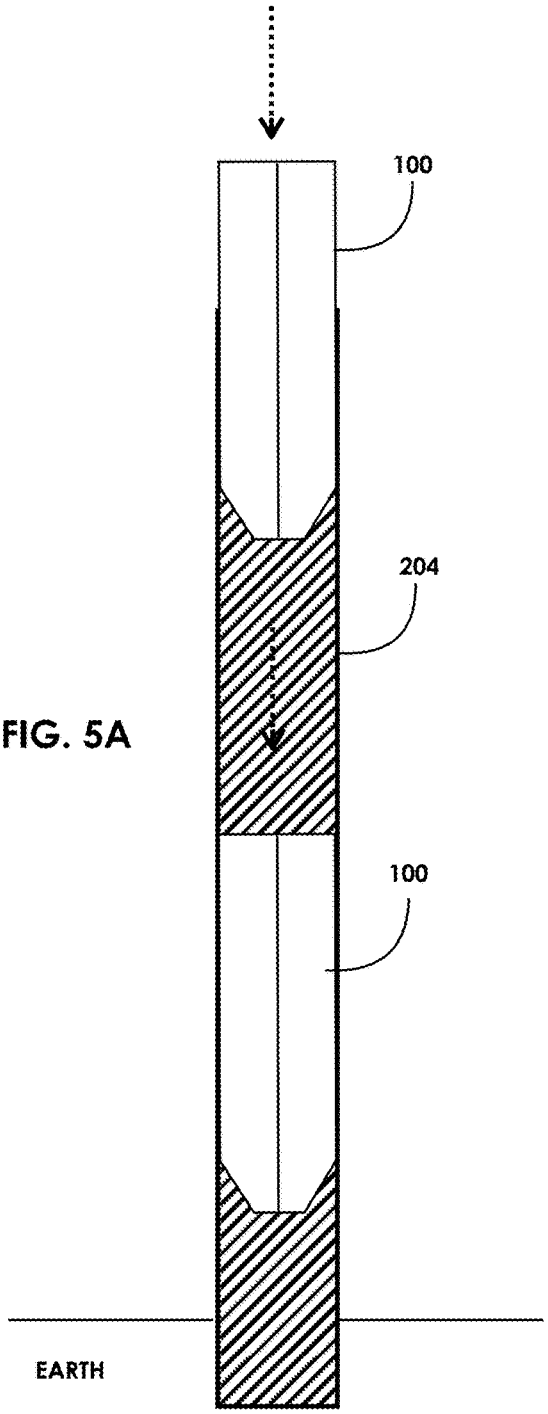
FIGS. 5A-5B illustrates a partial cross-section side view of a post and the post repair and reinforcement apparatus of FIG. 1, further illustrating another non-limiting exemplary embodiment of a method of repairing the post via the apparatus of the disclosure described herein.
Figure 5B:
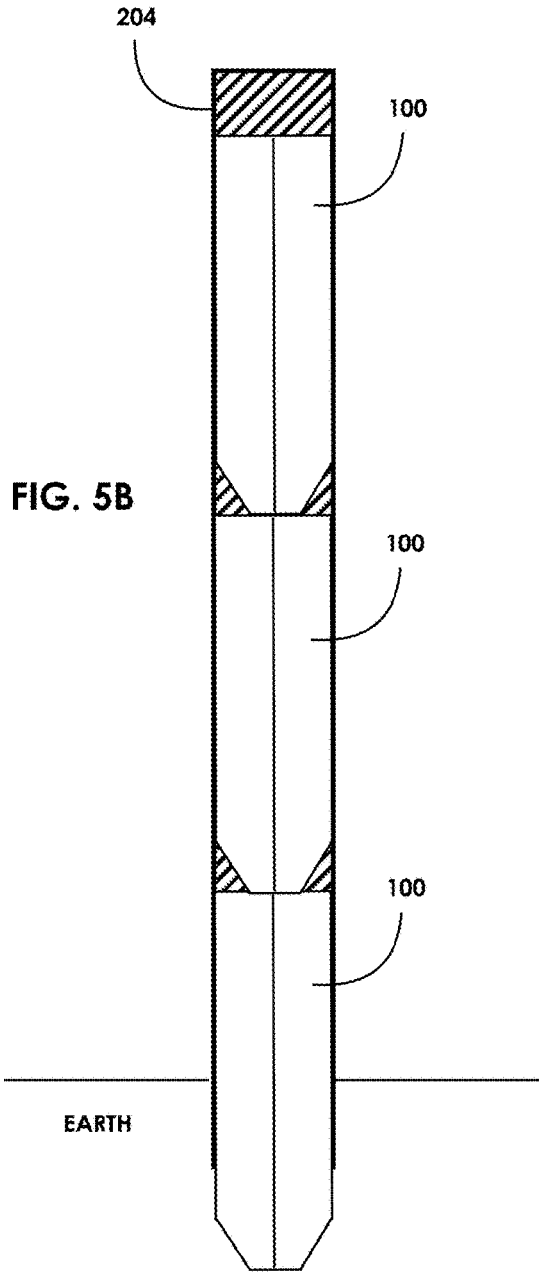

FIGS. 5A-5B illustrate another non-limiting exemplary embodiment of stake 100 being inserted within a damaged or compromised post 204 to further reinforce it. In particular, a cross-sectional side view of hollow tubular post 204 is shown, wherein multiple stakes 100 can be inserted and stacked on top of each other within post 204 to provide additional repair or additional structural rigidity. For example, post 204 may have multiple areas where its structure is compromised or damaged, thereby requiring more than one stake 100 to be inserted within post 204 at various locations along its length. In addition, as shown in FIG. 5B, a lower stake 100 may also be driven into the earth or ground to further support post 204 in an upright or vertical configuration and to further secure post 204 to the ground. In addition, the tapered region of stake 100 in combination its vanes further allow each of the stakes to self-center within post 204. Further, any type of lubing, grease, or oil may be applied to each of the stakes 100 to assist them in being inserted and driven down post 204. In addition, any type of material, fluid, or substance may be further poured or disposed within post 204 and over stake 100 (the fluid, substance, or material flowing passthrough or along vanes 102) to further harden and reinforce post 204 and stake 100. For example, such substance or material may include concrete or any type of adhesive or polymer that may be cured to harden. In addition, any type of sealant or paint may be used on the outer surface of post 204 to further prevent environmental damage to post 204 or stake 100, such as preventing corrosion.

Here, stake 100 is generally configured to be used for the repair and reinforcement of posts used for fences, such as wire, metal, or wooden privacy and security fences. However, it is contemplated within the scope of the present disclosure described herein that stake 100 of the disclosure described herein may be used for any application with respect to repairing or reinforcing any type of pipe or tube.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A method of repairing and reinforcing a tubular post, comprising:

inserting at least a first stake, second stake, and a third stake, each having tapered end formed via a plurality of vanes in a radial configuration, into a top open end of a tubular post, wherein the tubular post is damaged or compromised at a first location along its length; and positioning the first stake, second stake, and a third stake within the tubular post in a staked configuration, such that either the first stake, second stake, or third stake is positioned adjacent to the first location, thereby reinforcing the tubular post.

2. The method of claim 1, wherein a distal end region of each of the vanes comprises a sloped surface relative to a straight surface.

3. The method of claim 2, wherein each of the vanes extend from one end to another opposing end of each of the first stake, second stake, and third stake.

4. The method of claim 3, wherein each of the vanes comprise a flat distal end and a flat proximal end, and wherein the flat distal end and the flat proximal end are parallel relative to each other.

5. The method of claim 1, wherein the step of positioning further comprises aligning a middle region of the first stake, second stake, or third stake adjacent to the first location.

6. The method of claim 1, further comprising disposing or pouring a substance within the tubular post to harden or cure within the tubular post.

7. The method of claim 6, wherein the substance is comprised of concrete, adhesive, or a sealant.

8. The method of claim 1, wherein the step of inserting is further comprised of driving the first stake, second stake, and third stake via an elongated member in combination with a weighted member repeatedly engaging the elongated member.

9. The method of claim 8, wherein the weighted member is comprised of a hammer or mallet, and the elongated member is comprised of at least one of a rod, pipe, or tube.

10. The method of claim 1, wherein the tubular post is in a bent configuration at about the first location, wherein an upper region of the tubular post is at an angle relative to a lower region of the tubular post.

11. The method of claim 1, wherein the step of inserting the at least first stake, second stake, and third stake into the tubular post substantially straightens the bent configuration of the tubular post such that its upper region is within the same plane as its lower region.

12. The method of claim 1, applying a lubricant to an exterior surface of each of the first stake, second stake, and third stake or within the tubular post.

13. A method of repairing and reinforcing a tubular post, comprising:

inserting at least a first stake and second stake, each having a plurality of vanes wherein each of the vanes comprise a sloped side and straight side relative to each other, into a top open end of a tubular post, wherein the tubular post is damaged or compromised at a first location along its length; and positioning the first stake and second stake within the tubular post in a stacked configuration, such that either the first stake or second stake is positioned adjacent to the first location, thereby reinforcing the tubular post.

14. The method of claim 13, wherein the tubular post is in a bent configuration at about the first location, wherein an upper region of the tubular post is at an angle relative to a lower region of the tubular post.

15. The method of claim 14, wherein the step of inserting the at least first stake and second stake into the tubular post substantially straightens the bent configuration of the tubular post such that its upper region is within the same plane as its lower region.

16. The method of claim 13, wherein each of the vanes extend from one end to another opposing end of each of the first stake and second stake.

17. The method of claim 16, wherein each of the vanes comprise a flat distal end and a flat proximal end, wherein the flat distal end and the flat proximal end are parallel relative to each other.

18. A method of repairing and reinforcing a tubular post, comprising:

inserting at least a first stake having a plurality of vanes wherein each of the vanes comprise a sloped side and straight side relative to each other, into a top open end of a tubular post, wherein the tubular post comprises an upper region bent at an angle from about a first location along its length relative to a lower region; and positioning the first stake within the tubular post such that the first stake is positioned adjacent to the first location and aligns the upper region of the tubular post with the lower region of the tubular post.

19. The method of claim 18, wherein each of the vanes extend from one end to another opposing end the first stake.

20. The method of claim 19, wherein each of the vanes comprise a flat distal end and a flat proximal end, wherein the flat distal end and the flat proximal end are parallel relative to each other.

* * * * *